US006846978B2

(12) United States Patent
Dorfman et al.

(10) Patent No.: US 6,846,978 B2
(45) Date of Patent: Jan. 25, 2005

(54) STRAINER FOR A DRUM

(75) Inventors: Michael Dorfman, Prairie View, IL (US); Robert Szwaya, East Troy, WI (US); George Szwaya, East Troy, WI (US)

(73) Assignee: Trick Percussion Products, Inc., Schaumburg, IL (US)

( * ) Notice: Subject to any disclaimer, the term of this patent is extended or adjusted under 35 U.S.C. 154(b) by 99 days.

(21) Appl. No.: 10/377,259

(22) Filed: Feb. 27, 2003

(65) Prior Publication Data

US 2004/0168563 A1 Sep. 2, 2004

(51) Int. Cl.[7] ..... G10D 13/02
(52) U.S. Cl. ..... 84/415; 84/411 R; 84/416
(58) Field of Search ..... 84/415, 411 R, 84/416

(56) References Cited

U.S. PATENT DOCUMENTS 4,246,825 A * 1/1981 Hodas ..... 84/415
4,339,982 A 7/1982 Hoshino
4,383,467 A 5/1983 Glassford, Jr.
4,787,286 A 11/1988 Okumura
5,107,742 A 4/1992 Cummings et al.
5,507,214 A 4/1996 Hoshino
5,557,053 A 9/1996 Nickel
5,559,296 A 9/1996 Yamashita
5,616,875 A 4/1997 Lombardi
5,684,257 A 11/1997 Yanagisawa
5,895,873 A * 4/1999 Yanagisawa ..... 84/415
6,008,445 A 12/1999 Chen
6,020,547 A 2/2000 Chen
6,093,877 A 7/2000 Nickel
6,177,620 B1 1/2001 Alulyan
6,441,287 B1 8/2002 Crouch et al.

OTHER PUBLICATIONS

V. Ryan, The Design and Technology Site—The Cylindrical/Barrel Cam http://www.technologypupil.com/cams/cam9.htm© 2002 , Accessed Feb. 7, 2003.

* cited by examiner

*Primary Examiner*—Shih-Yung Hsieh
(74) *Attorney, Agent, or Firm*—Beem Patent Law Firm

(57) ABSTRACT

A snare drum strainer mountable to the shell of a drum comprises a piston and an actuator. The piston has an axis and a surface curved about an axis generally parallel to the piston axis, and the piston is operatively connected to snares. The actuator and the curved surface rotate one with respect to the other about an axis generally parallel to the piston axis to reciprocate the piston and to tension and untension the snares. In another embodiment, the piston includes a generally cylindrical surface with a generally helical groove, the piston is operatively connected to snares, and the actuator includes a follower insertable into the generally helical groove. The follower and the generally cylindrical surface rotate one with respect to the other to reciprocate the piston and tension and untension the snares.

20 Claims, 3 Drawing Sheets

STRAINER FOR A DRUM

BACKGROUND OF THE INVENTION

1. Field of the Invention

The present invention is directed to a strainer for use with a drum, in particular to an adjustable strainer for use with a snare drum.

2. Description of the Related Art

Snare drums typically include a plurality of wires, or snares, which contact a bottom drumhead of the snare drum so that the snares are vibrated by the vibration of the bottom drumhead when the snare drum is played. A strainer is typically used to tension the snares in order to change the tone produced by the drum by changing the position of the snares so that they are either in contact or not in contact with the drumhead.

U.S. Pat. Nos. 5,557,053 and 6,093,877 to Nickel are examples of conventional strainers for snares of a snare drum. These strainers use a lever directly connected to a piston, wherein the lever pivots about an axis generally perpendicular to the piston, so that when the lever is pivoted from one position to another, the piston drops and the tension in the snares is released so that the snares are no longer in contact with the drumhead. The pivoting lever of strainers such as these can only be operated so that the snares are either in contact with the drumhead (snares-on mode), or not in contact with the drumhead (snares-off mode), and are not adjustable to different tensions in between. Further, the strainer tends to be tensioned or released quickly, so that the snares make an unwanted "throw-off" noise against the drumhead, which is very undesirable, particularly for orchestral musicians. Also, the housings of Nickel's strainers are made from plastic, and have been known to break after only a few months of repeated use in a percussion environment.

U.S. Pat. No. 4,787,286 to Okumura, U.S. Pat. No. 5,559,296 to Yamashita, and U.S. Pat. No. 6,008,445 to Chen also disclose strainers for snare drums wherein a lever pivots about an axis generally perpendicular to a piston, similar to Nickel. Further, none of these disclose a continuously adjustable strainer that prevents the unwanted throw-off noise described above.

U.S. Pat. No. 5,684,257 to Yanagisawa discloses a strainer having a lever that pivots about an axis generally perpendicular to a slider assembly and that can be adjusted to various discrete positions between the snares-on and the snares-off modes. However, this strainer does not teach a strainer that is continuously adjustable. Further, this strainer can still create the undesirable throw-off noise described above, particularly if it is adjusted quickly.

What is needed is a strainer that avoids the problems described above.

BRIEF SUMMARY OF THE INVENTION

In accordance with the present invention, a snare drum strainer mountable to a shell of a drum is provided. The inventive strainer includes a piston and an actuator. The piston has an axis and a surface curved about an axis generally parallel to the piston axis, wherein the piston is operatively connectable to snares. The actuator and the curved surface rotate one with respect to the other about an axis generally parallel to the piston axis to cammingly engage one another to reciprocate the piston to tension and untension the snares.

Also in accordance with the present invention, a novel snare drum strainer mountable to a shell of a drum is provided having a piston and an actuator. The piston has a generally cylindrical surface with at least one generally helical groove, and the piston is operatively connectable to snares. The actuator includes a follower insertable into the generally helical groove, wherein the follower and the generally cylindrical surface rotate one with respect to the other to reciprocate the piston to tension and untension the snares.

Also in accordance with the present invention, a novel and improved snare drum is provided. The novel snare drum includes snares, a shell, at least one drumhead, and a strainer mountable to the shell, the strainer having a piston and an actuator, wherein the piston has a generally cylindrical surface with at least one generally helical groove and is operatively connected to snares, and the actuator includes a follower insertable into the generally helical groove, wherein the follower and the generally cylindrical surface rotate one with respect to the other to reciprocate the piston to tension and untension the snares.

The rotational camming engagement of the strainer, for example between the follower and the helical groove, allows for continuous control of the tension of the snares over at least a portion of the motion of the strainer, so that different sounds can be selected between the snares-on mode and the snares-off mode. Also, the rotational camming engagement of the present invention prevents the unwanted throw-off noise described above because the camming engagement of the actuator and piston is smooth, and does not jerk the snares into, or out of, the snares-on mode.

These and other objects, features and advantages are evident from the following description of an embodiment of the present invention, with reference to the accompanying drawings.

DETAILED DESCRIPTION OF THE INVENTION

Figure 1:
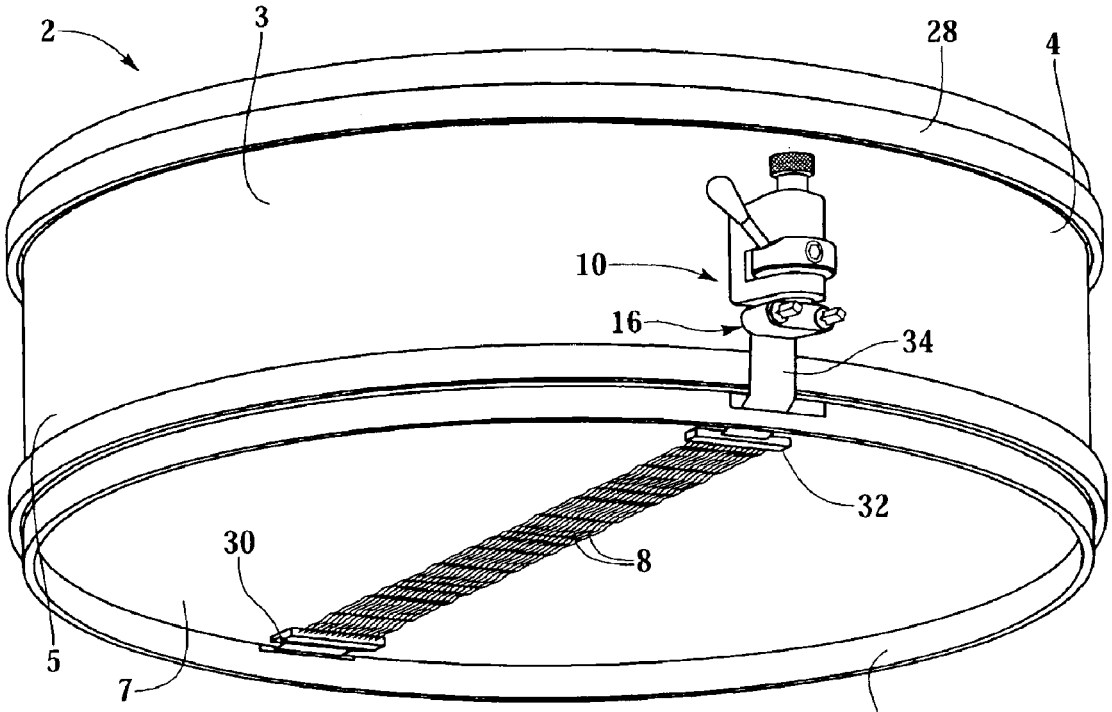
FIG. 1 is perspective view of a snare drum shown with snares in a snares-on mode.
Figure 2:
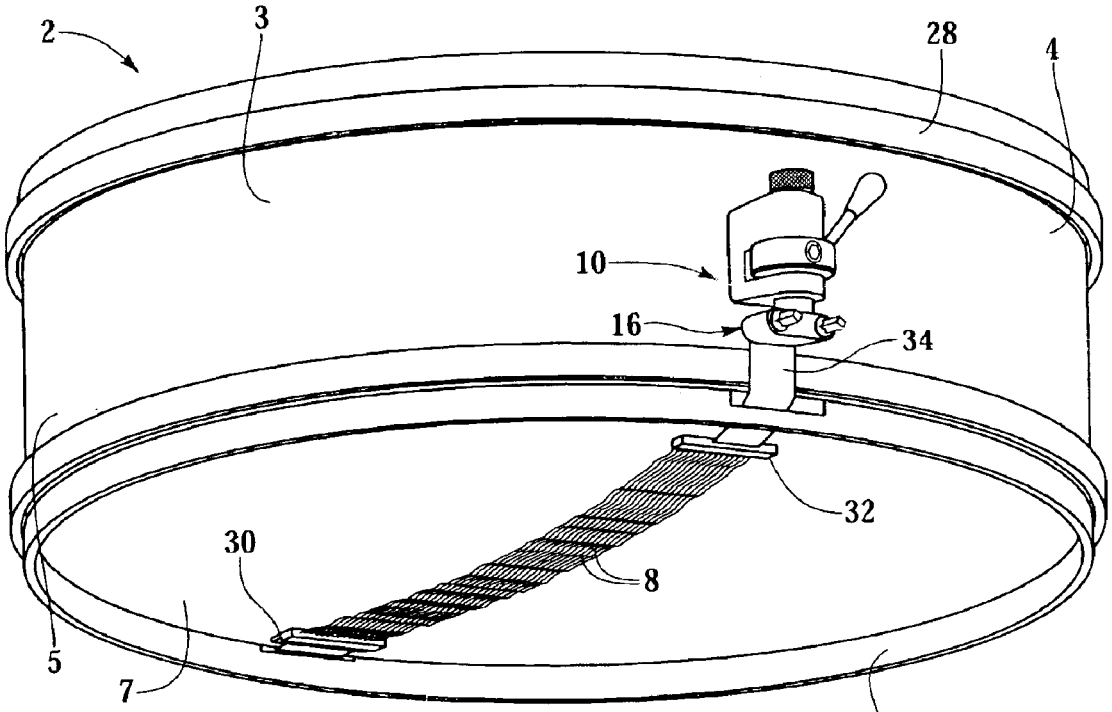
FIG. 2 is a perspective view of the snare drum shown with the snares in a snares-off mode.

A strainer 10, sometimes called a "throw-off" mechanism, for use on a snare drum 2 is shown in FIGS. 1 and 2. Snare drum 2 includes a shell 3 having an upper end 4 and a lower end 5, with an upper drumhead (not shown) mounted on upper end 4 and a lower drumhead 7 mounted on lower end 5. A plurality of snares 8 are mounted to snare drum 2 so that they are proximate and generally parallel to lower drumhead 7.

Snares 8 are movable between a tensioned, or snares-on mode, as shown in FIG. 1, and an untensioned, or snares-off mode, as in FIG. 2. Snares 8 are tensioned and untensioned by strainer 10 of the present invention. The novel strainer 10 includes a piston 14 mountable to shell 3 of drum 2 so that piston 14 can reciprocate, and an actuator 18 cammingly engageable with piston 14. Piston 14 has an axis of reciprocation 20 and a surface 22 curved around an axis 21 that is generally parallel to axis of reciprocation 20. Snares 8 are operatively connectable to piston 14, such as by snare clamp 16 shown in FIG. 1. In one embodiment, piston 14 is retained within a housing 12 connected to shell 3 so that piston 14 is reciprocatably mounted to shell 3, see FIGS. 3A–5A Either actuator 18 or curved surface 22 is rotatable so that one rotates with respect to the other about an axis 23 generally parallel to axis of reciprocation 20 to cammingly engage each other to reciprocate piston 14 to tension and untension snares 8.

In one embodiment, curved surface 22 has at least one groove 24*a* extending both laterally around piston 14 and axially along piston 14, and actuator 18 includes a follower 26*a* insertable into groove 24*a*. In one embodiment, groove 24*a* extends laterally about piston 14 between about 90° and about 360°, preferably between about 120° and about 270°, still more preferably about 180°. As groove 24*a* extends laterally about curved surface 22, it also extends axially along curved surface 22 for an axial length L (shown in FIG. 7A). The axial length L is selected to provide sufficient tension in snares 8 in their snares-on mode and to provide adequate release of snares 8 in the snares-off mode.

In one embodiment, groove 24*a* is generally spiral shaped extending along curved surface 22 and curving around axis of curvature 21, wherein groove 24*a* curves generally along piston surface 22 in both a lateral and an axial direction. Generally spiral groove 24*a* guides follower 26*a* so that it follows a generally spiral path with respect to piston 14, wherein piston 14 moves in the direction of axis of reciprocation 20 as actuator 18 rotates with respect to piston 14. In one embodiment, generally spiral groove 24*a* extends around piston 14 for between about ¼ and about 1 turn, preferably between about ⅓ and about ⅔ of a turn, and still more preferably about ½ of a turn around piston 14.

In another embodiment, curved surface 22 of piston 14 is generally cylindrical in shape, and there is at least one generally helical groove 24*a* in generally cylindrical surface 22. Actuator 18 includes a follower 26*a* insertable into generally helical groove 24*a*, wherein follower 26*a* and generally cylindrical surface 22 rotate one with respect to the other to reciprocate piston 14 to tension and untention snares 8.

The rotational camming engagement between piston 14 and actuator 18 moves piston 14 from a first, or snares-on position, shown in FIG. 1, to a second, or snares-off position, shown in FIG. 2. In a preferred embodiment, shown in FIGS. 1 and 2, piston 14 has a generally vertical orientation with respect to drum shell 3.

Drum

Snare drum 2 includes snares 8, at least one drumhead 7, a shell 3, and strainer 10 mountable to shell 3. In one embodiment, shell 3 is generally cylindrical in shape; however snare drum 2 can be of other shapes without varying from the scope of the present invention.

In one embodiment, an upper drumhead (not shown) is mounted to shell 3 at an upper end 4 and a lower drumhead 7 is mounted to shell 3 at a lower end 7. The drumheads can be mounted to shell 3 by any means known in the art, for example rims 28 and 29 which are secured to shell 3.

Preferably, snares 8 are mounted to snare drum 2 so that snares 8 are proximate and generally parallel to lower drumhead 7. Snares 8 can be mounted to shell 3 directly, or snares 8 can be mounted to rim 28 or 29. In one embodiment, snares 8 are mounted to lower rim 29 so that snares 8 are in contact with lower drumhead 7 when snares 8 are in the snares-on mode, as shown in FIG. 1. In a preferred embodiment, snares 8 are mounted to snare drum 2 by a snare anchor 30 mounted to lower rim 29 at one end of snares 8, while the other end of snares 8 is mounted to a reciprocating snare anchor 32 which is operatively connected to piston 14 via a strap 34 and snare clamp 16. As piston 14 moves from the snares-on position to the snares-off position, snares 8 are moved from their tensioned or snares-on mode to their untensioned or snares-off mode.

Housing

Continuing with FIG. 1, piston 14 is mounted to shell 3 by housing 12 of strainer 10 connected to shell 3 so that a player of snare drum 2 can easily change snares 8 from the snares-on mode to the snares-off mode simply by changing strainer 10 from its first position to its second position. In one embodiment, housing 12 is mounted to shell 3 via mounting screws (not shown) which are inserted through mounting holes in shell 3 (not shown). Piston 14 can also be mounted to shell 3 by one or more brackets or a frame.

Figure 6:
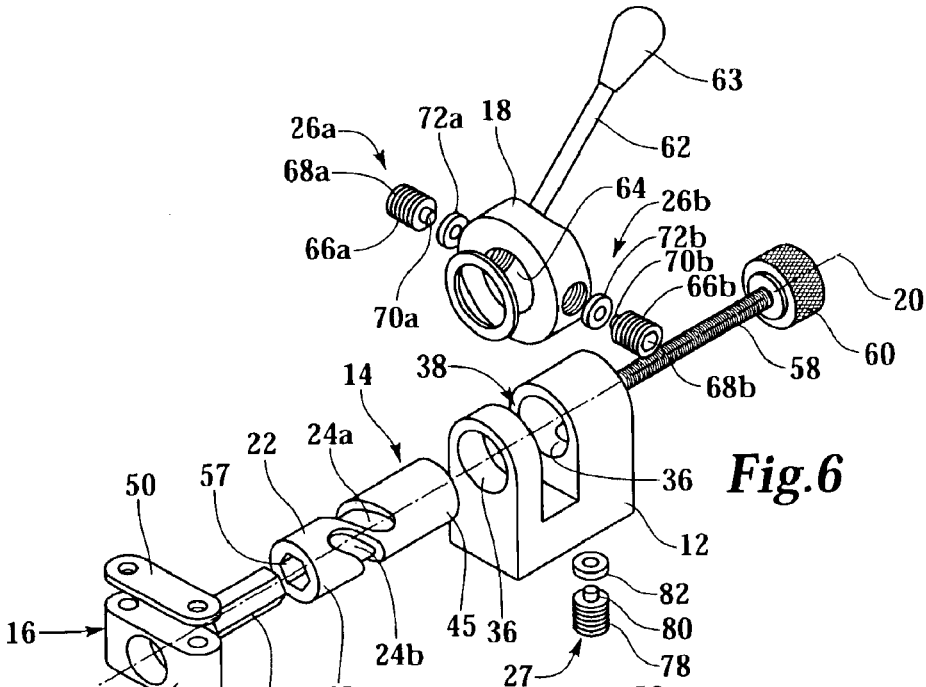
FIG. 6 is an exploded perspective view of the strainer of the present invention.

Turning to FIG. 6, housing 12 includes a bore 36 extending through housing 12 for receiving piston 14. Preferably, bore 36 has a cross-sectional shape that complements the cross-sectional shape of piston 14 so that piston 14 will easily slide along housing bore 36. For example, for the generally cylindrical piston 14 shown in FIG. 6, bore 36 is also generally cylindrical in shape, wherein there is a small allowance between the bore 36 and piston 14. In one embodiment, housing 12 also includes a recess 38 for receiving actuator 18 so that actuator 18 can engage with piston 14, as described below. Housing 12 can also include a guiding follower 27 which is inserted into a guiding groove 40 in piston 14, described below. In one embodiment, shown in FIG. 6, guiding follower 27 comprises a set screw 78 having a shank 80, wherein set screw 78 is threadingly engageable with a hole (not shown) in housing 12. Guiding follower 27 can also include a bearing 82 coupled with shank 80. In a preferred embodiment, bearing 82 is a roller bearing mountable on shank 80 of set screw 78, wherein roller bearing 82 is insertable into guiding groove 40 of piston 14.

Piston

Figure 7A:
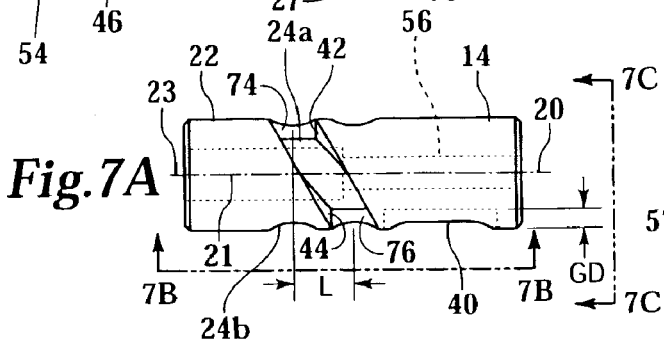
FIG. 7A is a plan view of a piston of the strainer taken along line 7A—7A in FIG. 7B.
Figure 7C:
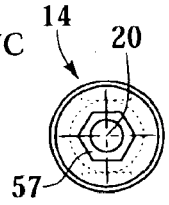
FIG. 7C is a plan view of the piston take along the line 7C—7C in FIG. 7A.

Turning to FIGS. 3A–5A, piston 14 is mounted to shell 3, such as by inserting piston 14 through bore 36 in housing 12, so that piston 14 can move between its snares-on position and its snares-off position. Piston 14 includes an axis of reciprocation 20, shown in FIG. 7A, and a piston surface 22 curved around an axis of curvature 21 generally parallel to axis of reciprocation 20. In one embodiment, axis of curvature 21 and axis of reciprocation 20 are one and the same, as shown in FIG. 7A.

Piston surface 22 cammingly engages with actuator 18, as described below, to reciprocate piston 14 from its snares-on position to its snares-off position to tension and untension snares 8. In a preferred embodiment, shown in FIG. 6, there is at least one generally helical groove 24*a* in piston surface 22. In one embodiment, piston 14 also includes a guiding groove 40 (see FIG. 7A) for receiving a guiding follower 27 (FIG. 6) for guiding piston 14 as it moves from its snares-on position to its snares-off position and for preventing piston 14 from rotating relative to housing 12.

In one embodiment, curved piston surface 22 is generally cylindrical in shape so that curved piston surface 22 comprises at least a portion of a generally cylindrical wall. In a preferred embodiment, piston surface 22 is shaped like a generally cylindrical wall around a substantial portion of the circumference of a cylinder. However, piston surface 22 does not have to be continuous around the circumference of piston 14, nor must piston surface 22 have a generally circular cross section, as shown in FIG. 6. In one embodiment, piston 14 is generally cylindrical in shape having a length of between about 2 inches and about 2¼ inches, preferable about 2⅛ inches and a diameter of between about ½ inches and about ⅞ inches, preferably about 11/16 inches.

Helical groove 24*a* extends around piston surface 22 and receives a follower 26*a* for cammingly engaging with actuator 18, as described below. In one embodiment, shown in FIGS. 7A, 7B and 8, there are two helical grooves 24*a, b* spaced laterally from each other on piston surface 22 so that one helical groove 24*a* is spaced around piston surface 22 from the other helical groove 24*b* by a predetermined number of degrees. In a preferred embodiment, the first helical groove 24*a* starts at a generally opposite side of, or about 180° around piston 14 as the second helical groove 24*b* and extends around about 180° of the circumference of piston surface 22.

Figure 7B:
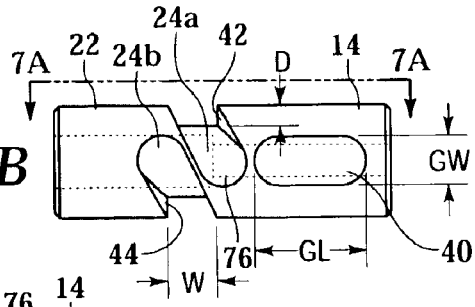
FIG. 7B is a plan view of the piston taken along the line 7B—7B in FIG. 7A.

Continuing with FIGS. 7A and 7B, each helical groove 24*a, b* has a width W, a depth D, and an axial length L. In one embodiment, each helical groove 24*a, b* has a length L in the axial direction of between about ¼ inches and about ½ inches preferably about ⅜ inches for a helical groove 24*a, b* that extends around between about 90° and about 360°, preferably between about 120° and about 240°, and still more preferably about 180° of piston surface 22, a width W of between about ⅜ inches and about ¾ inches, preferably about 5/16 inches and a depth D of between about 1/16 inches and about ¼ inches, preferably about ⅛ inches.

Each helical groove 24*a, b* receives and cammingly engages with a follower 26*a, b* to move piston 14 from its snares-on position to its snares-off position. Followers 26*a, b* slide or roll along helical grooves 24*a, b* and engage groove walls 42 and 44 in order to bias piston 14 in one direction or the other. For example, in one embodiment, shown in FIGS. 3B through 5B, when actuator 18, described below, is moved from its snares-on position to its snares-off position, follower 26*a* slides along helical groove 24*a* and follower 26*b* slides along helical groove 24*b* in a counter-clockwise direction and cammingly engages with top groove wall 42, allowing gravity to bias piston 14 generally downwardly from its snares-on position to its snares-off position. If a player of snare drum 2 wishes to return snares 8 to the snares-on mode, actuator 18 is moved from its snares-off position to its snares-on position so that followers 26*a, b* slide or roll along helical grooves 24*a, b* in a clockwise direction so that followers 26*a, b* cammingly engage with a top groove wall 42 to bias piston 14 generally upwardly from its snares-off position to its snares-on position. In another embodiment (not shown), actuator 18 remains generally stationary and piston 14 is rotated so that helical grooves 24*a, b* are guided by followers 26*a, b*.

Figure 8:
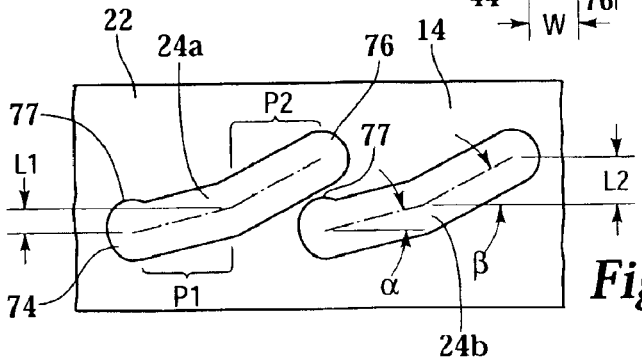
FIG. 8 is a projection of a generally cylindrical wall onto a plane showing a helical groove detail of generally helical grooves of the piston.

In one embodiment, best seen in the preferred helical detail of FIG. 8, each helical groove 24*a, b* extends from a lower end 74 to an upper end 76 and includes a first portion P1 having a first axial length L1, and a second portion P2 having a second axial length L2. In a preferred embodiment, first portion P1 has a first helical angle α corresponding to a small first axial length L1, whereas second portion P2 has a second helical angle β corresponding to a large second axial length L2. Helical grooves 24*a, b* can also include a locking detent 77 to lock piston 14 into place in its snares-on position. In one embodiment, detent 77 is formed by a slightly upturned portion of helical groove 24*a, b* at leading end 74 into which follower 26*a, b* settles.

In one embodiment, first portion P1 extends around between about 60° and about 120°, and preferably about 90° of piston surface 22, or about half of the turn of each helical groove 24*a, b*, and second portion P2 extends around the remainder of helical groove 24*a, b* so that a follower 26*a, b* following helical groove 24*a, b* from the snares-on position to the snares-off position will first slide along first portion P1 and then along second portion P2.

A small helical angle α or β, corresponding to a small axial length L of helical groove 24, allows for easier tuning of the vertical position of piston 14 because piston 14 is moved by a small amount as actuator 18 is rotated. Conversely, a large helical angle α or β corresponding to a large axial length L of helical groove 24 allows piston 14 to be adjusted quickly because piston 14 is moved by a large amount as actuator 18 is rotated.

In one embodiment, helical angle a of first portion P1 is a small angle of between about 10° and about 20°, and preferably angle α is about 15° so that for a cylindrical piston 14 having a diameter of about 11/16 inches the axial length L1 of first portion P1 is about 1/10 inches. A relatively small angle α is preferred to allow for tuning of strainer 10 in the tensed range where snares 8 will still vibrate against lower drumhead 7 when snare drum 2 is played. A predetermined helical angle α is selected so that it is small enough to provide friction between top groove wall 42 and follower 26*a, b* that is sufficient to prevent piston 14 from dropping prematurely to its snares-off position.

Helical angle β of second portion P2 can be between about 20° and about 30°, and preferably is about 25° so that for an 11/16 inch diameter cylindrical piston 14, the axial length L2 of second portion P2 is about 11/40 inches, so that the total axial length L of each helical groove 24 is about ⅜ inches. A predetermined angle β is selected so that it is large enough to provide insufficient friction to hold between top groove wall 42 and follower 26*a, b*, thus, piston 14 slides due to gravity and the tension of snares 8 as well as being biased by actuator 18 until it is in the snares-off position.

In one embodiment, piston 14 includes a guiding groove 40 (FIG. 7A) for receiving guiding follower 27 (shown in FIG. 6) to guide piston 14 as it moves from its snares-on position to its snares-off position and to ensure that piston 14 does not rotate with respect to housing 12 as followers 26*a, b* cammingly engage with helical grooves 24*a, b*. In a preferred embodiment, guiding groove 40 runs generally axially along piston 14 and has a width GW of between about 3/16 inches and about ½ inches, preferably about 5/16 inches, a depth GD of between about 1/16 inches and about ¼ inches, preferably about ⅛ inches and a length GL of between about ½ inches and about 9/10 inches, preferably about 7/10 inches for an 11/16 inch diameter piston 14.

Snares 8 are operative connected to piston 14. In one embodiment, snares 8 are operatively connected to piston 14 via a snare clamp 16 mounted to a lower end 46 of piston 14 so that when piston 14 moves from its snares-on position to its snares-off position, snare clamp 16 also moves from a first or snares-on position to a second or snares-off position. In a preferred embodiment, shown in FIGS. 1 and 2, snare clamp 16 clamps a strap 34 operatively connected to snares 8.

In one embodiment, snare clamp 16 includes a main portion 48 and a clamping plate 50 mountable to main portion 48 with clamp screws 52. A tongue 54 can also be mounted to main portion 48, wherein tongue 54 is insertable into a piston bore 56 in piston 14. A threaded rod 58 is insertable through piston bore 56, as shown in FIG. 6, wherein threaded rod 58 can threadingly engage a threaded hole (not shown) in tongue 54. In a preferred embodiment, threaded rod 58 is also coupled to a knurled adjustor knob 60 for fine tuning of the tension of snares 8. Adjustor knob 60 can be rotated so that threaded rod 58 rotates with respect to tongue 54 causing the effective length of snare clamp 16 and threaded rod 58 to change, adjusting the tension in snares 8.

In a preferred embodiment, tongue 54 and a portion of piston bore 56 at the lower end 46 of piston 14 have a cross sectional shape that prevents rotation of tongue 54 with threaded rod 58 as adjustor knob 60 is turned. In one embodiment, shown in FIG. 6, tongue 54 and piston bore 56 have a generally hexagonal cross section while threaded rod 58 has a generally circular cross-section sized to fit within piston bore 56 without interference, so that threaded rod 58 will rotate easily within piston bore 56, but tongue 54 will not.

Actuator

Returning to FIGS. 3B–5B, actuator 18 causes piston 14 to move from its snares-on position to its snares-off position by cammingly engaging with piston surface 22. In one embodiment, actuator 18 is retained within recess 38 of housing 12 (shown in FIG. 6) so that actuator 18 is rotatable around piston 14 so that actuator 18 can cammingly engage piston surface 22. In one embodiment, actuator 18 includes at least one follower 26*a* insertable into helical groove 24*a*. In a preferred embodiment, wherein there are two helical grooves 24*a, b*, as described above, actuator 18 includes two followers 26*a, b* for cammingly engaging with helical grooves 24*a, b*. Actuator 18 can also include a handle 62 having a knob 63 so that a player of snare drum 2 can easily turn actuator 18 whenever it is desired.

Preferably, actuator 18 is generally annular in shape, as shown in FIG. 6, with an actuator bore 64 for surrounding piston 14. Followers 26*a, b* extend radially inwardly into actuator bore 64 and into helical grooves 24*a, b* to cammingly engage with piston 14, best shown in FIGS. 3B through 5B. In one embodiment, followers 26*a, b* are extensions which extend radially inwardly from actuator 18.

Turning to FIG. 6, the extensions can be formed from set screws 66*a, b* which are threaded through actuator 18, wherein set screws 66*a, b* include a head 68*a, b* and a shortened shank 70*a, b* that extends into helical groove 24*a, b* to cammingly engage with groove walls 42 and 44. In a preferred embodiment, shown in FIG. 6, followers 26*a, b* include a bearing 72*a, b* coupled with shank 70*a, b* of set screw 66*a, b*, wherein bearing 72*a, b* engages with helical groove 24*a, b* to bias piston 14 from its snares-on position to its snares-off position. Bearing 72*a, b* can be one of several bearings known in the art, but preferably bearing 72*a, b* is an annular roller bearing, as shown in FIG. 6, mountable on shank 70*a, b* of set screw 66*a, b*. A roller bearing 72*a, b* can easily roll along helical groove 24*a, b* while cammingly engaging with groove walls 42 and 44 to bias piston 14. Although a roller bearing 72*a, b* mounted on a set screw 66*a, b* is shown as follower 26*a, b* in FIG. 6, other followers, such as a ball bearing retained within groove 24*a, b*, a pin, a tab, or another roller extending radially into actuator bore 64 can be used without varying from the scope of the present invention.

In the embodiment shown in the figures, wherein there are two helical grooves 24*a, b* laterally spaced about piston 14 by about 180°, followers 26*a, b* are also laterally spaced within actuator bore 64 by about 180° so that followers 26*a, b* generally correspond to helical grooves 24*a, b* for camming engagement between actuator 18 and piston 14.

Figures 3A, 3B, 4A, 4B, 5A, 5B:
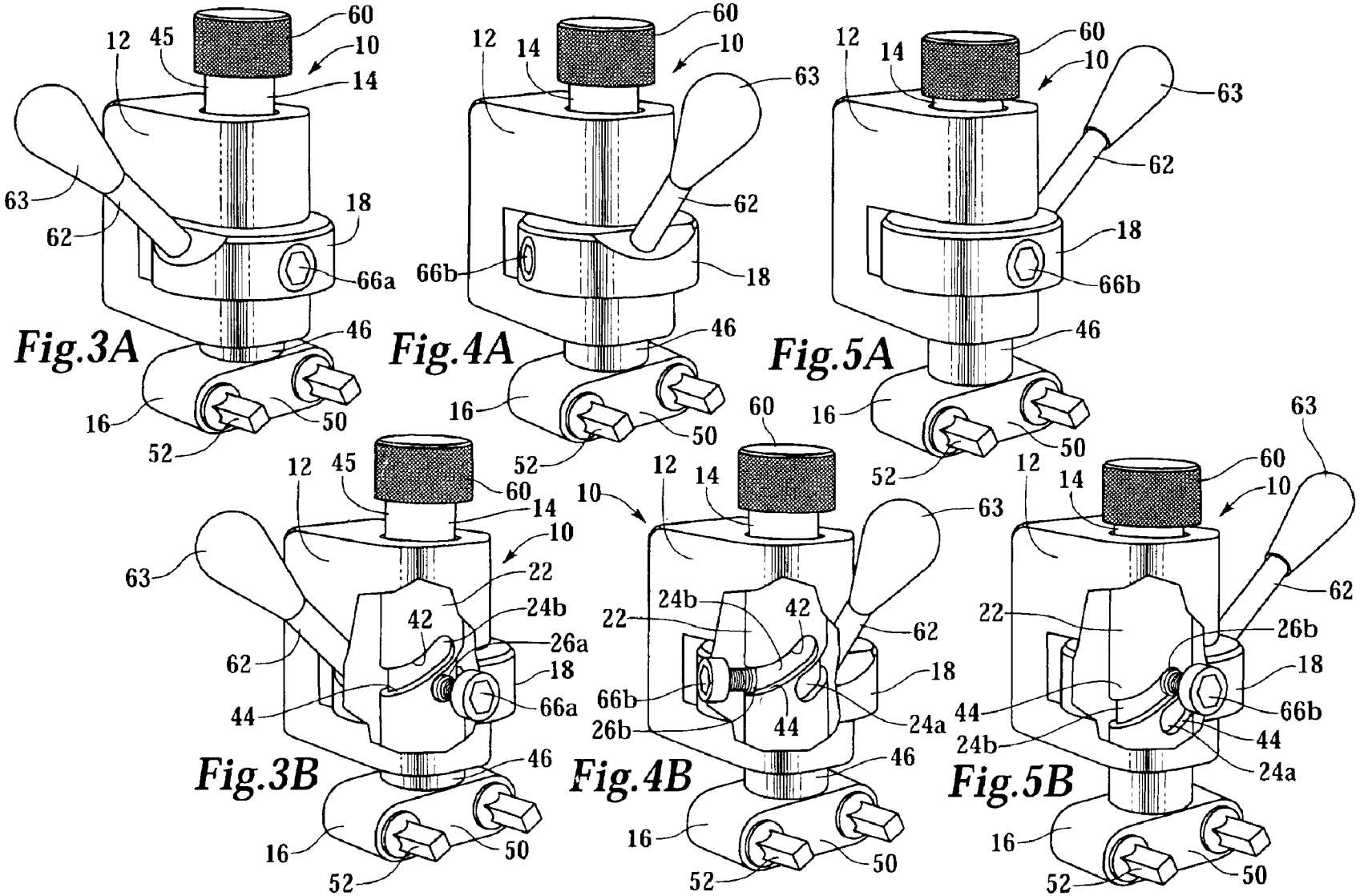
FIG. 3A is a perspective view of the strainer in a snares-on position.
FIG. 3B is a partially cut away perspective view of the strainer in the snares-on position.
FIG. 4A is a perspective view of the strainer between the snares-on position and a snares-off position.
FIG. 4B is a partially cut away perspective view of the strainer between the snares-on position and the snares-off position.
FIG. 5A is a perspective view of the strainer in the snares-off position.
FIG. 5B is a partially cut away perspective view of the strainer in the snares-off position.

In one embodiment, actuator 18 can be rotated with respect to piston 14 between a snares-on position, shown as a clockwise position in FIG. 3A, to a snares-off position, shown as a counterclockwise position in FIG. 5A. Actuator 18 rotates about an axis of rotation 23 generally parallel to axis of reciprocation 20. In a preferred embodiment, shown in FIG. 7A, axis of rotation 23 and axis of reciprocation 20 are one in the same. Conversely, as described above, piston 14 can be rotated while actuator 18 remains generally stationary (not shown).

As actuator 18 rotates with respect to piston 14 from its snares-on position to its snares-off position, followers 26*a, b* engage with groove wall 42 of helical grooves 24*a, b*, as described above, allowing gravity to bias piston 14 from its snares-on position to its snares-off position. In one embodiment, wherein there are two helical grooves 24*a, b* which each extend around about 180° of piston 14, actuator can only be rotated about one-half of a turn, or about 180°, so that each follower 26*a, b* moves from one end 74 of helical groove 24*a, b*, shown in FIG. 7B, to the other end 76.

In a preferred embodiment, actuator 18 includes a handle 62 with a knob 63, as shown in FIG. 3A, so that a player of snare drum 2 can easily grab and move actuator 18 from the snares-on position to the snares-off position, or vice versa.

Strainer 10 should be made from a material selected for durability sufficient to withstand wear under repeated use in a percussion environment. In one embodiment, piston 14 is made from hardened steel and other parts of strainer 10, including housing 12, actuator 18 and snare clamp 16, are made from machined aluminum so that strainer 10 will be resistant to wear.

Use and Advantages

Strainer 10 of the present invention allows the tension of snares 8 to be continually adjusted for at least a portion of the range between the snares-on mode and the snares-off mode. As followers 26*a, b* move along the first portion P1 of helical grooves 24*a, b*, rotation of actuator 18 can be stopped and piston 14 will remain generally in the same position until actuator is moved again. In this way, strainer 10 of the present invention can turn snares 8 partially off so that snares 8 still vibrate against lower drumhead 7 when a player of snare drum 2 strikes upper drumhead 6 but they do not produce a crisp crack as is typical of snares in the snares-on mode. Rather, snares 8 create a washy or muddy sound which may be desirable for certain musical situations. A smaller helical angle $\alpha$ of between about 10° and about 20°, preferably about 15° is selected to provide adequate friction between groove wall 42 and follower 26*a, b* sufficient to prevent piston 14 from dropping to its snares-off position.

Helical grooves 24*a, b* and followers 26*a, b* of the present invention cause the movement of piston 14 between its snares-on position and its snares-off position to be very smooth, so that snares 8 are not jerked upward or downward, preventing accidental and unwanted throw-off noise being generated by snares 8 striking lower drumhead 7.

As mentioned above, it is very undesirable to have an unwanted throw-off noise from snares 8 during a quiet portion of a musical piece, because the audience will easily hear the throw-off noise, which interferes with the quality of the music.

The camming engagement of the strainer of the present invention, particularly between the helical grooves and the followers, allows for quiet, smooth, and reliable operation of the strainer of the present invention. The inventive features are desirable for percussionists and particularly desirable in an orchestral setting, where the snares may have to be changed from the snares-on mode to the snares-off mode quickly during a quiet portion of a piece. Further a smaller helical angle in at least a portion of the helical grooves of the present invention allows for continuous control of the tension of the snares over at least a portion of the movement of the strainer, to allow for different sounds being produced by snares.

The present invention is not limited to the above-described embodiments, but should be limited solely by the following claims.

What is claimed is:

1. A snare drum strainer mountable to a shell of a drum comprising:

a piston and an actuator;

said piston having an axis and a surface having a generally spiral groove wherein said surface is curved about an axis generally parallel to said piston axis, wherein said piston is operatively connectable to snares; and wherein said actuator and said curved surface rotate one with respect to the other about an axis generally parallel to said piston axis to cammingly engage one another to reciprocate said piston to tension and untension said snares.

2. A snare drum strainer according to claim 1, wherein said curved surface comprises at least a portion of a generally cylindrical wall.

3. A snare drum strainer according to claim 1, wherein the tension of said snares is continuously adjustable for at least a portion of the reciprocation of said piston.

4. A snare drum strainer according to claim 1, wherein said piston is made from hardened steel.

5. A snare drum strainer according to claim 1, wherein said actuator is made from machined aluminum.

6. A snare drum strainer according to claim 1, wherein said actuator has a follower engageable with said generally spiral groove, wherein said follower and said curved surface rotate one with respect to the other to reciprocate said piston.

7. A snare drum strainer according to claim 1, wherein said curved surface has at least one groove extending both laterally and axially and said actuator has a follower engageable with said groove, wherein said follower and said curved surface rotate one with respect to the other to reciprocate said piston.

8. A snare drum strainer according to claim 7, wherein said groove extends axially for an axial length selected to provide sufficient tension when said snares are tensioned and to provide adequate release when said snares are untensioned.

9. A snare drum strainer mountable to a shell of a drum comprising:

a piston and an actuator;

said piston having a generally cylindrical surface with at least one generally helical groove, said piston is operatively connectable to snares; and said actuator having a follower engageable with said generally helical groove;

wherein said follower and said generally cylindrical surface rotate one with respect to the other to reciprocate said piston to tension and untension said snares.

10. A snare drum strainer according to claim 9, further comprising a second generally helical groove laterally spaced from said generally helical groove.

11. A snare drum strainer according to claim 9, wherein said generally helical groove includes a first portion having a first helical angle and a second portion having a second helical angle.

12. A snare drum strainer according to claim 11, wherein said first helical angle is between about 10 degrees and about 20 degrees.

13. A snare drum strainer according to claim 11, wherein said first helical angle is about 15 degrees.

14. A snare drum strainer according to claim 11, wherein said second helical angle is between about 20 degrees and about 30 degrees.

15. A snare drum strainer according to claim 11, wherein said second helical angle is about 25 degrees.

16. A snare drum strainer according to claim 9, wherein said follower comprises a set screw and a bearing coupled with said set screw to roll along said generally helical groove.

17. A snare drum strainer according to claim 16, wherein said bearing is a roller bearing mounted to a shank of said set screw.

18. A snare drum strainer according to claim 9, wherein the tension of said snares is continuously adjustable for at least a portion of the reciprocation of said piston.

19. A snare drum comprising:

snares, a shell, at least one drumhead, and a strainer mountable to said shell;

said strainer including a piston and an actuator, said piston having a generally cylindrical surface with at least one generally helical groove, wherein said snares are operatively connected to said piston, said actuator having a follower engageable with said generally cylindrical groove, wherein said follower and said generally cylindrical surface rotate one with respect to the other to reciprocate said piston to tension and untension said snares.

20. A snare drum strainer according to claim 19, wherein the tension of said snares is continuously adjustable for at least a portion of the reciprocation of said piston.

* * * * *